US007350503B2

(12) United States Patent
Tanaka et al.

(10) Patent No.: US 7,350,503 B2
(45) Date of Patent: Apr. 1, 2008

(54) FUEL INJECTION PUMP

(75) Inventors: Masamichi Tanaka, Osaka (JP); Tohru Ogawa, Osaka (JP); Satoshi Hattori, Osaka (JP)

(73) Assignee: Yanmar Co., Ltd. (JP)

( * ) Notice: Subject to any disclaimer, the term of this patent is extended or adjusted under 35 U.S.C. 154(b) by 178 days.

(21) Appl. No.: 10/535,625

(22) PCT Filed: Nov. 14, 2003

(86) PCT No.: PCT/JP03/14553

§ 371 (c)(1),
(2), (4) Date: Jan. 4, 2006

(87) PCT Pub. No.: WO2004/046525

PCT Pub. Date: Jun. 3, 2004

(65) Prior Publication Data

US 2006/0153719 A1 Jul. 13, 2006

(30) Foreign Application Priority Data

Nov. 21, 2002 (JP) ..... 2002-337727

(51) Int. Cl.
*F02D 1/02* (2006.01)
*F02D 1/16* (2006.01)
*F02D 1/08* (2006.01)
*F02M 59/42* (2006.01)

(52) U.S. Cl. ..... 123/362; 123/179.17; 123/366; 123/501

(58) Field of Classification Search ..... 123/362, 123/366, 357, 381, 179.16, 179.17, 500, 123/501, 502
See application file for complete search history.

(56) References Cited

U.S. PATENT DOCUMENTS

| | | | | |
|---|---|---|---|---|
| 4,112,897 | A * | 9/1978 | Hufendiek | 123/366 |
| 4,489,698 | A * | 12/1984 | Hofer et al. | 123/502 |
| 6,953,022 | B1 * | 10/2005 | Itsuki et al. | 123/364 |
| 7,051,706 | B2 * | 5/2006 | Tanaka et al. | 123/357 |
| 7,152,585 | B2 * | 12/2006 | Tanaka | 123/500 |
| 2006/0048750 | A1 * | 3/2006 | Tanaka et al. | 123/357 |
| 2006/0112936 | A1 * | 6/2006 | Tanaka et al. | 123/501 |

FOREIGN PATENT DOCUMENTS

| | | |
|---|---|---|
| JP | 2000-234529 | 8/2000 |
| JP | 2000-234576 | 8/2000 |
| JP | 2001-349262 | 12/2001 |
| JP | 2001-355541 | 12/2001 |

* cited by examiner

*Primary Examiner*—Stephen K. Cronin
*Assistant Examiner*—Arnold Castro
(74) *Attorney, Agent, or Firm*—Sterne, Kessler, Goldstein & Fox P.L.L.C.

(57) ABSTRACT

A fuel injection pump 100 comprises a thermoelement CSD 47 for advancing injection timing in a cold temperature condition. The CSD 47 uses a piston 46 for opening and closing a sub port 42 formed in a plunger barrel 8. An electronic governor 2 is provided with a mechanism for decreasing an injected fuel quantity when an engine starts in a cold temperature condition. The mechanism shifts a rack position in a fuel-decrease direction in a cold temperature condition, and switches the rack position to a normal position in a normal temperature condition. A timing TR for shifting the rack position is set before or simultaneous to a timing TC for switch-off of the CSD 47.

11 Claims, 17 Drawing Sheets

Fig. 1

| | CSD | Governor | Mechanism for Switch-off of CSD |
|---|---|---|---|
| Fuel Injection Pump 100 | Thermoelement CSD 47 | Electronic Governor 2 | |
| Fuel Injection Pump 200 | Electronic CSD 9 | Electronic Governor 2 | |
| Fuel Injection Pump 300 | Electronic CSD 9 | Mechanical Governor 17 | |
| Fuel Injection Pump 400 | Electronic CSD 9 | Electronic Governor 2 | Timer 22 |
| Fuel Injection Pump 500 | Electronic CSD 9 | Electronic Governor 2 | Sensor 24 |

1 · · · Good Cold Start
2 · · · Decrease of Black Exhaust Gas
3 · · · Reduction of Noise, Reduction of NOx

FUEL INJECTION PUMP

BACKGROUND OF THE INVENTION

1. Field of the Invention

The present invention relates to a fluid injection pump, especially to configure thereof for controlling fluid injection timing and quantity.

2. Background Art

In comparison with a gasoline engine, a diesel engine exhausts gas containing a low percentage of CO and HC, however, containing a high percentage of NOx. Therefore, an important problem of the diesel engine is reduction of NOx contained in exhaust gas. Conventionally, there is a fluid injection pump equipped with a cold start device (hereinafter, "CSD") for advancing injection timing at clod temperature, serving as an art to keep smooth start of an engine at clod temperature while keeping a low percentage of NOx in exhaust gas. The CSD advances injection timing at cold temperature by controlling a piston to open-and-close a sub port for overflow formed in a plunger barrel.

An example is disclosed in JP 2000-234576A by the same applicant.

The art is applicable to a fuel injection pump as shown in FIG. 20, including a plunger 7 and a plunger barrel 8 with a fuel compression chamber 44 therebetween, wherein plunger 7 is reciprocated so as to suck fuel from a fuel gallery 43 into fuel compression chamber 44 through a main port 14, and to discharge fuel from fuel compression chamber 44 to a connection duct 49 extended to a distribution shaft.

The fuel injection pump has overflow passage generally configured as follows. A fuel drain circuit is formed so as to drain fuel from fuel compression chamber 44 through a sub port 42. The fuel drain circuit includes an open-and-close valve mechanism portion in which a piston 46 fluid-tightly slides for opening and closing sub port 42.

The fuel injection pump is provided with a thermoelement CSD 47 serving as an actuator which actuates according to change of temperature. Thermoelement CSD 47 is constituted by a thermoelement which is extended and contracted according to change of temperature so as to raise and lower piston 46.

The CSD makes piston 46 open sub port 42 when an engine is in the normal temperature, so as to delay fuel injection start timing. The CSD makes piston 46 close sub port 42 when the engine is cold, so as to prevent sup port 42 from draining fuel, thereby advancing the fuel injection start timing.

Due to the configuration, the advance of fuel injection timing for the cold engine prevents misfire so as to optimize cold-temperature start of engine, and the delay of fuel injection timing decreases exhausted NOx when the engine temperature is higher than a certain value, e.g., when the engine normally drives.

In FIG. 21, each of graphs (a) and (b) represents an injected fuel quantity of the fuel injection pump shown in FIG. 20 relative to rotary speed in each of the cold temperature (opening the sub port) case and the normal temperature (closing the sub port) case. It is understood from the graphs that, due to the cold-temperature actuation of the CSD for closing the sub port, the injected fuel quantity is increased at a constant rate regardless of engine rotary speed to be larger than that when the sub port is opened in the normal temperature. The increase of injected fuel may cause increase of noise, overload on an engine, increase of NOx in exhaust gas, and black exhaust gas.

On the other hand, FIG. 22 graphs out fuel timing of the fuel injection pump shown in FIG. 20 relative to pump (engine) rotary speed and to temperature. When the temperature is normal, the CSD does not actuate and the sup port is entirely opened so as to set a late fuel injection timing T1, which is constant regardless of the pump (engine) rotary speed, as a graph (b). Fuel injection timing T1 is determined so as to obtain required effect of reduction of noise and NOx.

When the engine starts in a cold temperature condition where the sub port is entirely closed by actuation of the thermo-sensing CSD 47, an early fuel injection timing T2 is obtained. As the engine rotary speed (pump rotary speed) is increased, the engine is warmed so that the thermoelement of the CSD is gradually expanded, thereby gradually delaying the fuel injection timing. The delay of fuel injection timing effects reduction of black exhaust gas.

In the condition of setting early fuel injection timing T2, an engine can starts smoothly, however, the injected fuel quantity increases, as understood from FIG. 21, thereby causing black exhaust gas and overload on the engine.

In this way, a fuel injection pump provided with the conventional CSD obtains advanced fuel injection timing in compensation for the problems caused by the increase of injected fuel quantity, such as the increase of black exhaust gas and the overload on an engine.

SUMMARY OF THE INVENTION

According to the present invention, a fuel injection pump, including a plunger barrel formed with a sub port for overflow, is provided with a CSD having a piston which closes the sub port at the cold temperature. The fuel injection pump is subjected to cold governing for decreasing injected fuel by a governor so as to decrease an injected fuel quantity when an engine starts in a cold temperature condition.

Therefore, the injected fuel quantity during actuation of the CSD can be decreased to the level of injected fuel quantity when the CSD does not actuate. Consequently, black exhaust gas can be decreased when an engine is started or accelerated at a cold temperature. Furthermore, the injected fuel quantity is prevented from increasing immediately after engine start, thereby preventing the engine from being overloaded.

A timing for switching injection of the decreased fuel for the engine start in the cold temperature condition into normal injection of fuel in a normal temperature condition is set before or synchronous to a timing for switch-off actuation of the cold start device.

Therefore, the injected fuel quantity is increased by the governor before (or simultaneously to) start of decrease of injected fuel by switching-off the CSD, thereby preventing temporary decrease of injected fuel quantity, and preventing an engine from being troubled.

The governor includes an electronic actuator for the cold governing for decreasing injected fuel. A temperature of engine-cooling water is detected for switch-on/off of the CSD and for execution/cancel of the cold governing for decreasing injected fuel with the governor. The engine-cooling water is a suitable medium for detection of engine temperature required for controlling the CSD and for controlling the governor in correspondence to the CSD.

Therefore, the switch on/off shift of the CSD can be associated with the execution/cancel shift of the cold governing for decreasing injected fuel.

The CSD may be a thermoelement CSD sensing the temperature of the engine-cooling water, and the governor may be an electronic governor having a water temperature sensor so as to execute the fuel-decreasing governing when the detected temperature of the engine-cooling water is lower than a certain value.

Even if the detected cooling water temperature required for shifting the CSD between the switch-on condition and the switch-off condition is equal to the detected cooling water temperature required for execution/cancel shifting of the cold governing for decreasing injected fuel with the governor, the governor has a sensor for detecting the temperature of the engine-cooling water disposed on the upstream side of a thermoelement portion (wax) of the CSD in flow of the engine-cooling water, whereby, during the warm-up of the engine, the water temperature sensor of the governor detects the water temperature which increases earlier than the water temperature detected by the thermoelement of the CSD. Therefore, the fuel-decreasing governing by the governor is canceled before the switch-off of the CSD, thereby preventing the temporary decrease of injected fuel.

If the CSD sensing the engine cooling water temperature is an electronic CSD having a cooling water sensor which can be used as the cooling water sensor for the governor, the timing for shifting the CSD from the switch-on condition to the switch-off condition can be substantially simultaneous to the timing for shifting the governor from the fuel-decrease condition to the fuel-increase condition. Further, the number of parts and costs can be reduced.

The electronic governor, which can execute the cold governing for decreasing injected fuel, performs droop governing during the switch-on condition of the CSD and for a certain period after the shift of the switched-on CSD into the switch-off condition, and wherein the governor performs isochronus governing for the rest period while the CSD is switched off.

During the droop governing, the rotary speed after being decreased is kept constant, similar to the idle-up governing. Therefore, while an engine is started and accelerated, an operator operating a machine with the engine serving as the power source does not feel discomfort. The droop governing is turned to the isochronus governing when the warm-up of the engine is finished, thereby keeping a constant engine rotary speed regardless of increase of load, and ensuring stable work.

The governor is an electronic governor provided with two map data for controlling a maximum rack position of the governor. One of the map data is selected when the CSD is switched on, and the other map data is selected when the CSD is switched off.

Therefore, the governor rack position is controlled according to the data selected in correspondence to either the switch-on or switch-off condition of the CSD, thereby keeping a constant injected fuel quantity and constant output of an engine regardless of whether the CSD is switched on or off.

Alternatively, the governor is a mechanical governor, and a multi-step actuating solenoid is provided for moving a fulcrum of a governor lever of the mechanical governor in a fuel decreasing direction and in a fuel increasing direction.

The multi-step solenoid serving as the means for decreasing the injected fuel quantity can also serve as means for preventing the stationary engine from fuel injection, thereby saving a space for the governor.

A fuel injection pump of the present invention comprises an electronic CSD sensing a temperature of engine-cooling water. The CSD is switched off when a certain time is passed after an engine starts in a cold temperature condition, even if the increased temperature of the engine-cooling water does not reach a certain value.

Therefore, the CSD can be surely switched off even if the cooling water temperature cannot be detected because the cooling water sensor, a harness or the like has a problem, or even if an abnormally long time is required for increasing the cooling water temperature because a cooling water pump or the like has a problem. Namely, the CSD can be provided with a fail-safe function.

A fuel injection pump of the present invention comprises an electronic CSD sensing a temperature of engine-cooling water. The CSD is switched off based on detection of a signal indicating that a clutch of a working machine is engaged immediately after an engine starts in a cold temperature.

Therefore, in anticipation that an engine is loaded by driving the working machine, the CSD, which is another source of load, can be shifted into the switch-off condition so as to prevent the engine from being overloaded.

BRIEF DESCRIPTION OF THE DRAWINGS

FIG. 1 is a table showing control patterns of respective embodiments.

DETAILED DESCRIPTION OF THE INVENTION

Figure 2:
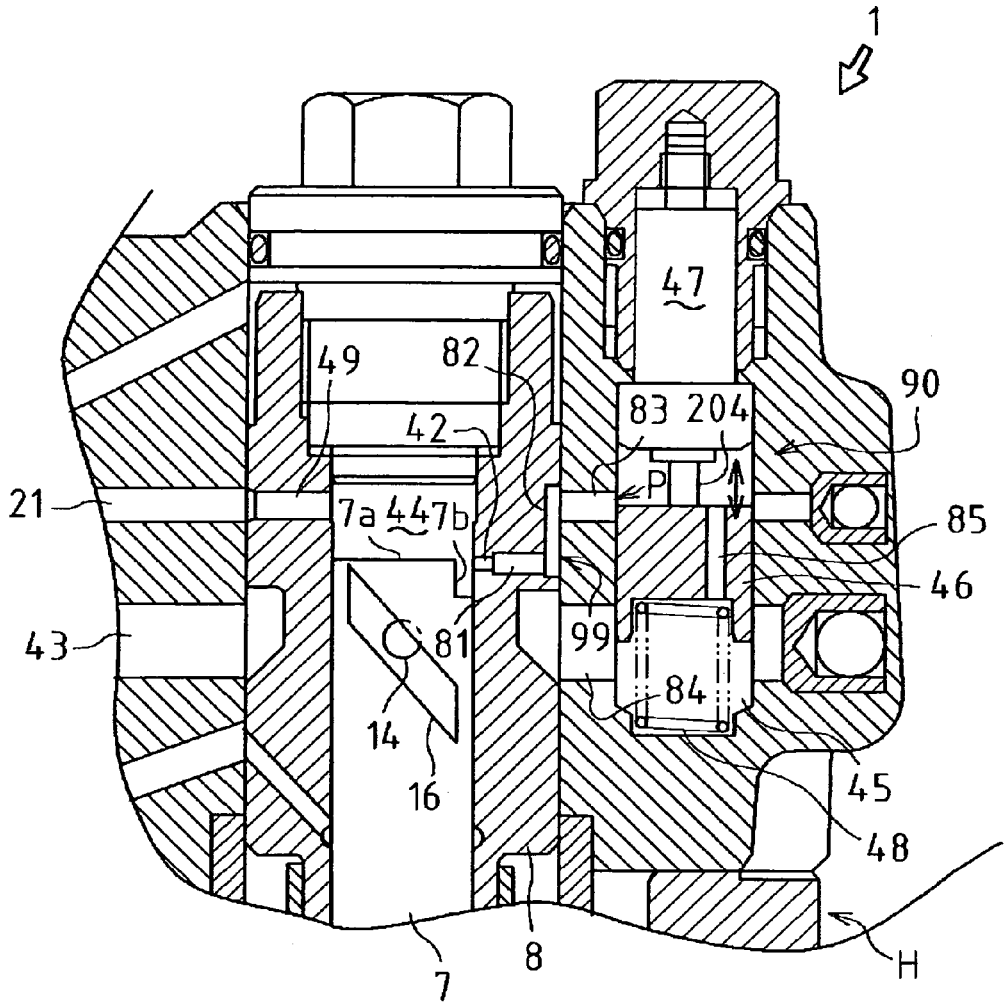
FIG. 2 is a fragmentary sectional view of a fuel injection pump 1 showing a portion thereof including a thermoelement CSD 47.

Five embodiments of a fuel injection pump of the present invention will be described.

The fuel injection pump of the present invention is provided with a cold start device (hereinafter, "CSD"), and controlled by a governor so as to decrease injected fuel at a cold temperature (cold governing for decreasing injected fuel).

As shown in FIG. 1, first to third embodiments define three different combinations of two different type CSDs with two different type governors.

A thermoelement CSD and an electronic CSD serve as the two different type CSDs. An electronic governor and a mechanical governor serve as the two different type governors. The two type governors have different control systems for ensuring the cold governing for decreasing injected fuel.

A fuel injection pump 100 according to the first embodiment comprises a thermoelement CSD 47 and an electronic governor 2. A fuel injection pump 200 according to the second embodiment comprises an electronic CSD 9 and electronic governor 2. A fuel injection pump 300 according to the third embodiment comprises electronic CSD 9 and a mechanical governor 17.

Each of fuel injection pumps 400 and 500 according to respective fourth and fifth embodiments comprises a canceling mechanism for canceling actuation of its CSD in a certain condition. Each of fuel injection pumps 400 and 500 is fuel injection pump 200 (having electronic CSD 9 and electronic governor 2) plus the canceling mechanism.

In the following description, each CSD designated by a simple word "CSD" may be either a thermoelement CSD or an electronic CSD, and each governor designated by a simple word "governor" may be either an electronic governor or a mechanical governor.

The fuel injection pumps of the respective embodiments have the same configuration excluding different types of the CSD and the governor. Therefore, fuel injection pump 100 will be detailed to some degree, and description of the same parts of the other fuel injection pumps 200, 300, 400 and 500 as those of fuel injection pump 100 will be omitted.

Fuel injection pump 100 according to the first embodiment will now be described. Fuel injection pump 100 is attached to an engine 10 so as to supply fuel to engine 10.

Figure 4:
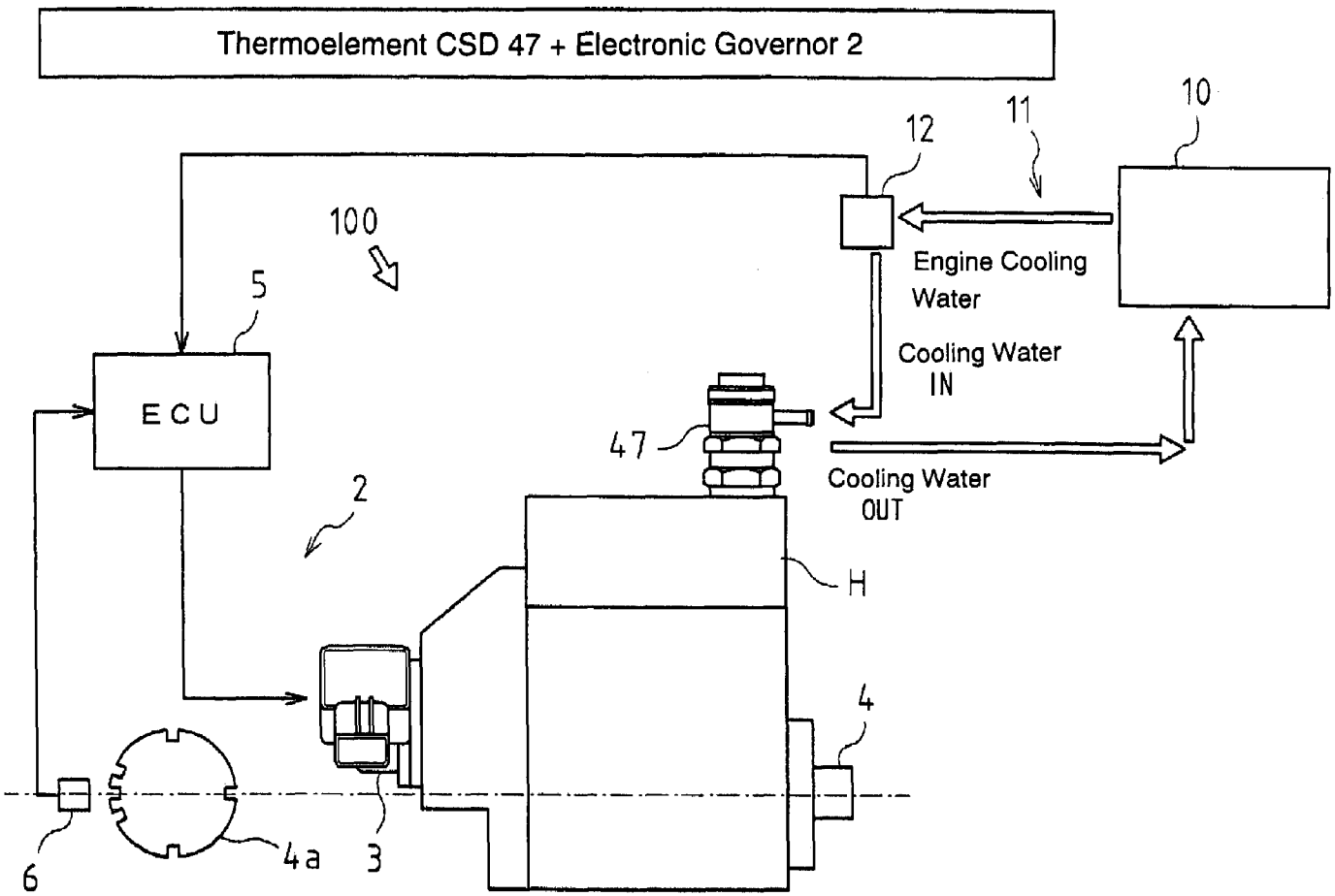
FIG. 4 is a systematic diagram of a fuel injection pump 100 including a thermoelement CSD 47 and an electronic governor 2.

As shown in FIG. 2, in fuel injection pump 100, a plunger 7 is vertically slidably fitted in a plunger barrel 8 so as to be vertically moved by a camshaft 4 (see FIG. 4). A distribution shaft is rotatably disposed beside plunger 7 and axially parallel to plunger 7. Camshaft 4 transmits its force to the distribution shaft through bevel gears or the like, thereby driving distribution shaft.

In a housing H, a trochoid pump is disposed so as to be driven by the rotation of camshaft 4. Fuel in a fuel tank is supplied to a fuel gallery 43 through a delivery passage connected to a delivery port of the trochoid pump.

As shown in FIG. 2, a fuel compression chamber 44 is formed in plunger barrel 8 above plunger 7 so as to compress fuel led thereinto. Plunger barrel 8 is formed therein with a main port 14, and with a connection port duct 49 connected to the distribution shaft, so that each of main port 14 and connection port duct 49 can be opened to fuel compression chamber 44. A fuel supply duct and fuel gallery 43 are bored in housing H, and communicate with main port 14 so as to constantly supply fuel into main port 14.

Therefore, fuel led from fuel gallery 43 into fuel compression chamber 44 through main port 14 is compressed by plunger 7 so as to be discharged into the distribution shaft through a connection duct 49 formed in an upper portion of plunger barrel 8 and fuel discharge duct 21 extended from connection duct 49. The distribution shaft is rotated as mentioned above so as to distribute fuel among delivery valves. The delivery valves charge the distributed fuel to respective injection nozzles so as to be injected.

A reference numeral 16 designates a plunger lead for setting an effective stroke of fuel charged by plunger 7. Plunger 7 is rotated around its center axis so as to change the height of plunger 7 for opening plunger lead 16 to main port 14.

A sub port 42 is open at an inner peripheral surface of plunger barrel 8. Plunger 7 has a top surface 7*a* for compressing fuel in fuel compression chamber 44 surrounded by plunger barrel 8. A sub lead 7*b* is formed in a top surface 7*a* of plunger 7 on the same side of sub port 42, so that, by setting the rotational position of plunger 7 in a certain range, fuel compression chamber 44 can be opened to sub port 42 through sub lead 7*b* while main port 14 is closed by the outer peripheral surface of plunger 7.

Plunger barrel 8 is formed therein with a radial fuel duct 81, and with an axial groove 82 at the outer peripheral surface of plunger barrel 8 and connected to radial fuel duct 81. A connection duct 83 and a valve chamber passage 45 are formed in housing H so as to communicate groove 82 to valve chamber passage 45 through connection duct 83.

Such ducts 81 and 83 and groove 82 constitute a drain passage 99. Drain passage 99, valve chamber passage 45 and a return passage 84 constitute a drain circuit 90 for returning fuel from fuel compression chamber 44 to fuel gallery 43.

Alternatively, drain circuit 90 may be configured to return fuel to the fuel tank out of housing H.

Due to the configuration, the outer peripheral surface of the head of plunger 7 closes main port 14 so as to start the discharge of fuel from fuel compression chamber 44 to connection duct 49 connected to the distribution shaft before vertically sliding plunger 7 reaches its upper dead point. At this time, although plunger 7 slides upward, fuel is drained from sub port 42 connected to sub lead 7*b*, thereby delaying the discharge of fuel.

The delay of the fuel discharge start timing can be adjusted by adjusting a depth of sub lead 7*b* or a height of sub port 42.

Fuel injection pump 100 having the above configuration is provided with a CSD for advancing injection timing in a cold temperature condition.

In this regard, a piston 46 is vertically shiftably and fluid-tightly fitted in valve chamber passage 45. When the temperature is cold, the CSD shifts piston 46 so as to close sub port 42 in plunger barrel 8, thereby advancing the cold fluid injection timing.

Consequently, fuel injection pump 100 is configured so as to delay the injection timing (start of fuel discharge) due to the depth of sub lead 7*b* and the height of sub port 42 in the normal temperature condition, and to advance the injection timing due to the CSD in the cold temperature condition.

This configuration will be more specified.

In the first embodiment, the CSD is thermoelement CSD 47. Thermoelement CSD 47 contains wax serving as a thermoelement for actuating piston 46, utilizing the characteristics of the wax which is contracted at a cold temperature and expanded at a high temperature.

A piston rod 204 projects outward from the thermoelement to be fixed to piston 46, so that piston 46 is shifted by expansion and contraction of the wax corresponding to the temperature. Piston 46 is penetrated by an axial duct 85.

A return spring 48 is disposed opposite to thermoelement CSD 47 with respect to piston 46, so as to bias piston 46 against the expansion actuation of thermoelement CSD 47.

Due to the configuration, when thermoelement CSD 47 detects a temperature rise and extends piston rod 204, piston 46 compresses return spring 48 so as to increase the elastic force of return spring 48.

Consequently, piston 46 becomes stationary at a position where piston 46 is balanced between the expansion force of thermoelement CSD 47 and the elastic force of return spring 48. The stationary position of piston 46 is decided depending upon the temperature detected by thermoelement CSD 47.

One end of connection duct 83 is an opening P, which is opened at a wall surface of valve chamber passage 45 and opened-and-closed by an outer peripheral surface of piston 46.

Due to the configuration, when engine 10 is in a cold condition, thermoelement CSD 47 contracts piston rod 204, and piston 46 is shifted by the returning force of spring 48 so as to completely close opening P by the outer peripheral surface thereof. Therefore, sub port 42 is closed to prevent the drain of fuel and prevent the delay of the fuel discharge start timing.

When the temperature of engine 10 in this cold condition is increased, thermoelement CSD 47 extends piston rod 204 to move piston 46 (downward in FIG. 2), thereby gradually increasing the open area of opening P to drain passage 99 against the outer peripheral surface of piston 46. Consequently, as the temperature is increased, the open area of sub port 42 for draining fuel is increased so as to gradually delay the fuel discharge start timing.

If the temperature of engine 10 becomes equal to or larger than a certain value, thermoelement CSD 47 completely opens opening P, i.e., sub port 42, thereby completely opening drain passage 99. Consequently, the fuel discharge start timing is delayed to a certain degree.

The condition that the engine temperature is within a range for completely opening sub port 42 is called as a normal (warm) temperature condition. The cold temperature condition is referred to as the condition that the engine temperature is in a range below the temperature range as the normal (warm) temperature range.

In other words, thermoelement CSD 47 controls piston 46 so as to close sub port 42 in the cold temperature condition, thereby preventing the delay of the fuel discharge start timing. Thermoelement CSD 47 controls piston 46 so as to open sub port 42 in the normal temperature condition, thereby delaying the fuel discharge start timing.

By actuating the CSD for advancing the fuel injection timing, fuel drained from fuel compression chamber 44 is decreased. Therefore, in the cold temperature condition, the injected fuel quantity is increased due to the actuation of the CSD, regardless of the engine rotary speed, in comparison with that in the normal temperature condition.

To prevent the increase of injected fuel quantity, a governor of the fuel injection pump decreases the injected fuel quantity in the cold temperature condition.

Based on an open area of an accelerator throttle and on the engine rotary speed, the governor provided to the fuel injection pump controls a control rack position in fuel injection pump 100 so as to change the injected fuel quantity.

Figure 3:
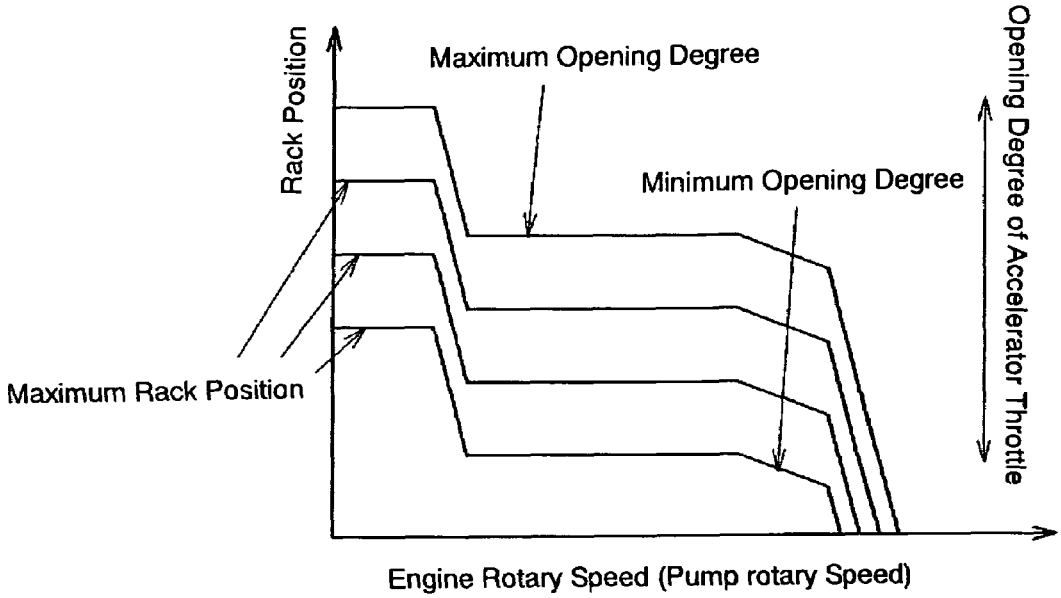
FIG. 3 illustrates graphs of rack position relative to engine rotary speed in conditions of respective opening degree of accelerator throttles.

As shown in FIG. 3, in a condition that the opening area of the accelerator throttle is kept constant, the governor controls the rack position in correspondence to the engine (pump) rotary speed according to a certain correlation between the rotary speed and the rack position. As the opening area of the accelerator throttle is increased, the rack position is shifted in a fuel fuel increasing direction so as to increase the injected fuel quantity. As the opening area of the accelerator throttle is decreased, the rack position is shifted in a fuel fuel decreasing direction so as to generally decrease the injected fuel quantity. Referring to FIG. 3, four graphs, each of which represents a variation of the rack position relative to the rotary speed, are distinguished from one another by difference of the open area of the accelerator throttle. The injected fuel quantity is not accurately proportional to correspondent to the rack position (see FIG. 7). However, as the rack position moves in the fuel fuel increasing direction, the injected fuel quantity is increased. As the rack position moves in the fuel fuel decreasing direction, the injected fuel quantity is decreased.

According to the governor, the variation of the injected fuel quantity in response to the rotary speed becomes different according to difference of opening degree of accelerator throttle, so as to be represented by different graphs. Further, as detailed later, it also becomes different when cold governing for decreasing injected fuel is performed. In other words, if the governing by the governor is shifted into the cold governing for decreasing injected fuel, and even if the opening degree of accelerator throttle is the same as that in the normal temperature condition, the effect is substantially equal to that when the opening degree of accelerator throttle is increased.

A maximum rack position means a rack position for injecting the maximum quantity of fuel every pump rotary speed in the condition that the opening degree of accelerator throttle is set constant, and that execution/cancel of the cold temperature reduction of injected fuel is constantly controlled. In other words, the maximum rack position is adjusted by not only change of the opening degree of accelerator throttle but also execution/cancel control of the cold governing for decreasing injected fuel.

The cold governing for decreasing injected fuel by the governor means the governing for decreasing injected fuel when an engine is started and accelerated at a cold temperature. The maximum rack position is shifted in a fuel decreasing direction for the reduction of injected fuel. In this way, due to adjustment of the maximum rack position, the rack position is shifted in the fuel decreasing direction so as to decrease injected fuel quantity.

As mentioned above, the adjustment of maximum rack position essentially depends to change of the opening degree of accelerator throttle, and further depends to the cold governing for decreasing injected fuel when an engine is started and accelerated at a cold temperature.

As shown in FIG. 4, according to a first embodiment, electronic governor 2 serves as the above governor for fuel injection pump 100. Electronic governor 2 includes an actuator 3 for changing a rack position of a control rack, and a controller 5 for controlling actuator 3. Of course, actuator 3 is an electronic actuator. Controller 5 uses a rotary sensor 6 for detecting rotation of a rotary sensor gear 4*a* provided on a camshaft 4, thereby controlling actuator 3 for controlling injected fuel quantity in correspondence to engine rotary speed.

In fuel injection pump 100, the control mechanism for electronic governor 2 is used for executing the cold governing for decreasing injected fuel.

Controller 5 also serves as a brain for executing the cold governing for decreasing injected fuel. At the cold temperature, controller 5 controls actuator 3 so as to shift the maximum rack position in the fuel decreasing direction so as to decrease the injected fuel quantity.

Figure 5:
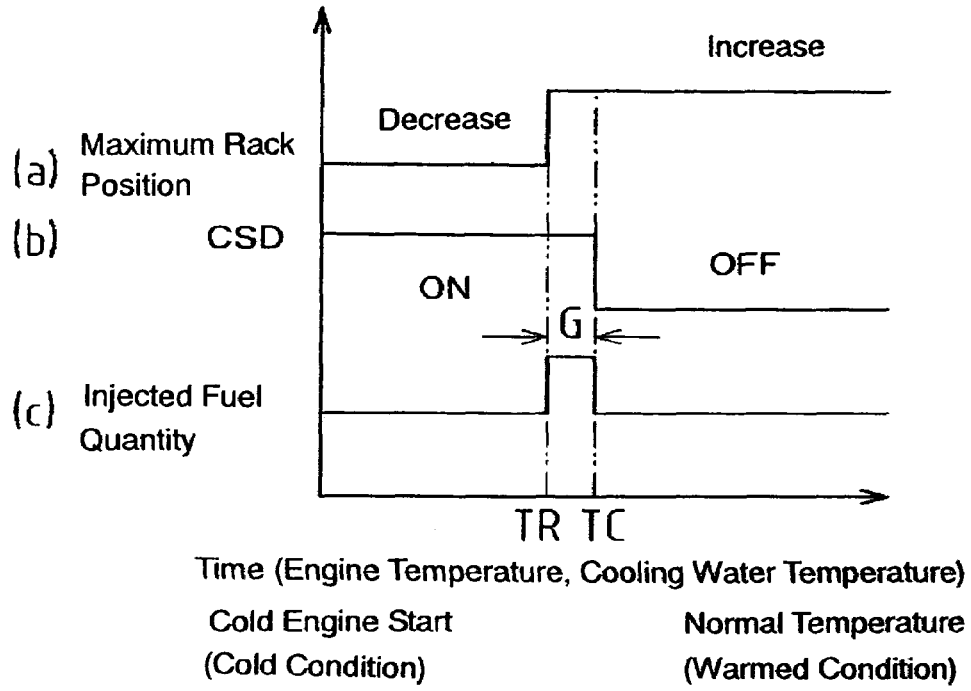
FIG. 5 illustrate a graph (a) of change of maximum rack position, a graph (b) of change of on/off condition of CSD, and a graph (c) of change of governor control condition, with the common time passage (change of engine temperature or cooling water temperature) when an engine is started (or accelerated) in a cold temperature condition.

FIG. 5 illustrates the governing of injected fuel for fuel injection pump 100. Fuel injection pump 100 includes thermoelement CSD 47 and electronic governor 2 which can execute the cold governing for decreasing injected fuel. Detail of FIG. 5 will be discussed later. The governing will now be generally described.

As shown in FIG. 5, in the cold temperature condition, thermoelement CSD 47 is switched on to shift the rack position in the fuel decreasing direction. In the normal (warm) temperature condition, thermoelement CSD 47 is switched off to shift the rack position in a fuel increasing direction. The shift of rack position means the shift of maximum rack position.

Namely, fuel injection pump 100 decreases the injected fuel quantity when the temperature is cold. This meaning is that the shift of rack position in the fuel decreasing direction cancels the increase of injected fuel caused by actuation of the CSD.

Therefore, the injected fuel quantity in the switch-on condition of the CSD can be leveled down to that in the switch-off condition of the CSD, thereby reducing black exhaust gas when an engine is started and accelerated at a cold temperature.

Due to this, even if the CSD is switched on immediately after engine 10 starts, the injected fuel is prevented from increasing, thereby preventing engine 10 from being overloaded.

The above action and effect are not peculiar to fuel injection pump 100 including thermoelement CSD 47 and electronic governor 2. Any configuration may be adopted for the CSD and the governor. The only required point for the fuel injection pump is to include a CSD and to be subjected to the cold governing for decreasing injected fuel.

An alternative CSD may be an electronic solenoid type CSD (e.g., a later-discussed solenoid actuator 13). If the governor is a mechanical governor which shifts the rack position in correspondence to rotation of camshaft 4, an alternative mechanism for executing the cold governing for decreasing injected fuel may be a mechanism for shifting a fulcrum of a governor lever in the fuel decreasing direction (see a third embodiment).

Controller 5 for executing the cold governing for decreasing injected fuel depends upon rack position control map data for controlling the maximum rack position.

The rack position control map data is stored in a memory of controller 5.

Figure 6:
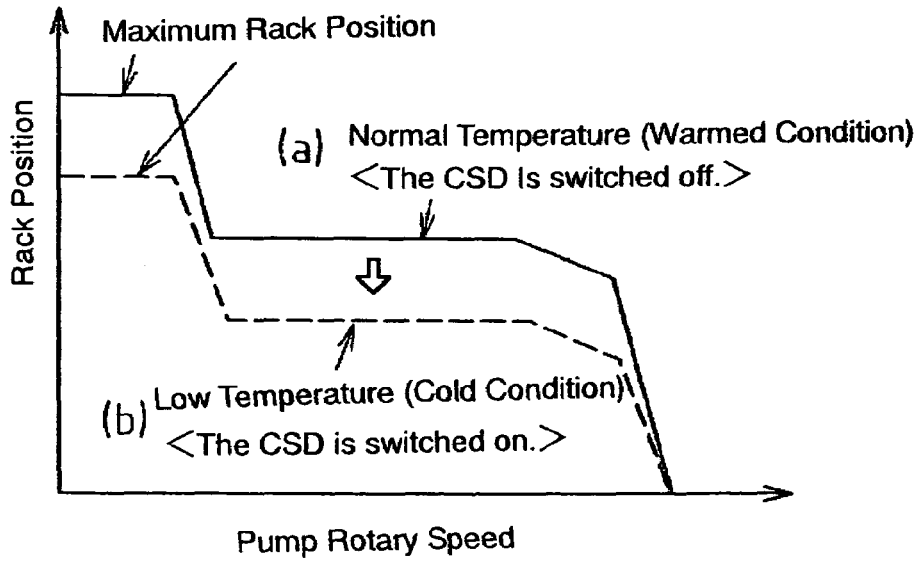
FIG. 6 illustrates a graph (a) of map data for rack position control in the normal temperature condition, and a graph (b) of map data for rack position control in the cold temperature condition.

As shown in FIG. 6, the rack position control map data consists of a pump rotary speed—rack position characteristic data in the normal (warm) temperature condition, and the characteristic data in the cold temperature condition.

The data in the normal temperature condition corresponds to the switch-off condition of the CSD. The data in the cold temperature condition corresponds to the switch-on condition of the CSD. To cancel the increase of injected fuel caused by the actuation of the CSD, the maximum rack position according to the data in the normal temperature condition is disposed in the fuel increasing direction in comparison with the maximum rack position according to the data in the cold temperature condition.

Figure 7:
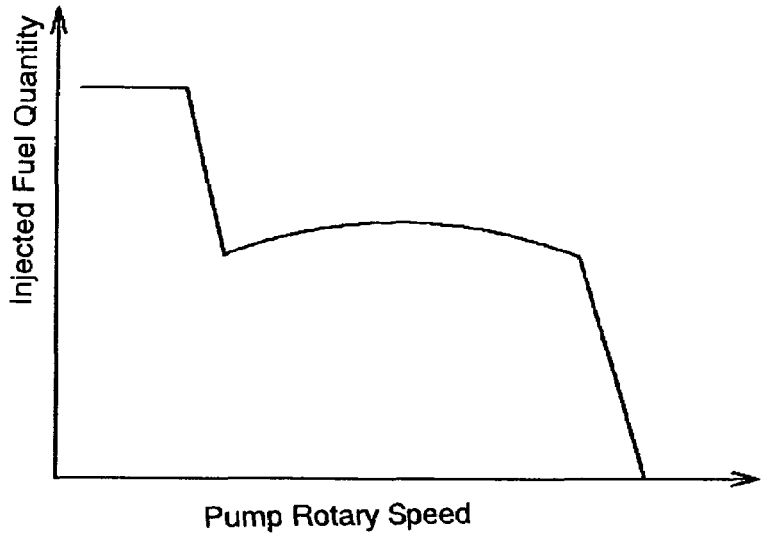
FIG. 7 graphs change of injected fuel quantity relative to pump rotary speed according to the map data for rack position control.

Therefore, as shown in FIG. 7, controller 5 selects either the data in the switch-on condition of the CSD or the data in the switch-off condition of the CSD, in correspondence to the switch-on or off of the CSD. The rack position is controlled according to the selected map data so as to keep constant injected fuel quantity regardless of whether the CSD is switched on or off, thereby ensuring constant engine power regardless of whether or not the CSD actuates.

Description will now be given of a timing of on/off switching of the CSD and a timing of execution/cancel switching of the cold governing for decreasing injected fuel.

As shown in FIG. 5, the CSD in the switch-on condition is shifted into the switch-off condition at a timing TC. On the other hand, due to the execution of the cold governing for decreasing injected fuel, the rack position is shifted at a timing TR so as to correspond to the shift of the CSD. In this regard, the rack position is shifted from a fuel decreasing position in the cold temperature condition to a fuel increasing position in the normal temperature condition.

In other words, timing TR for start of the cold governing for decreasing injected fuel is simultaneous with timing TC for the shift of the CSD or earlier than timing TC (In FIG. 5, timing TR is earlier than timing TC).

Figure 8:
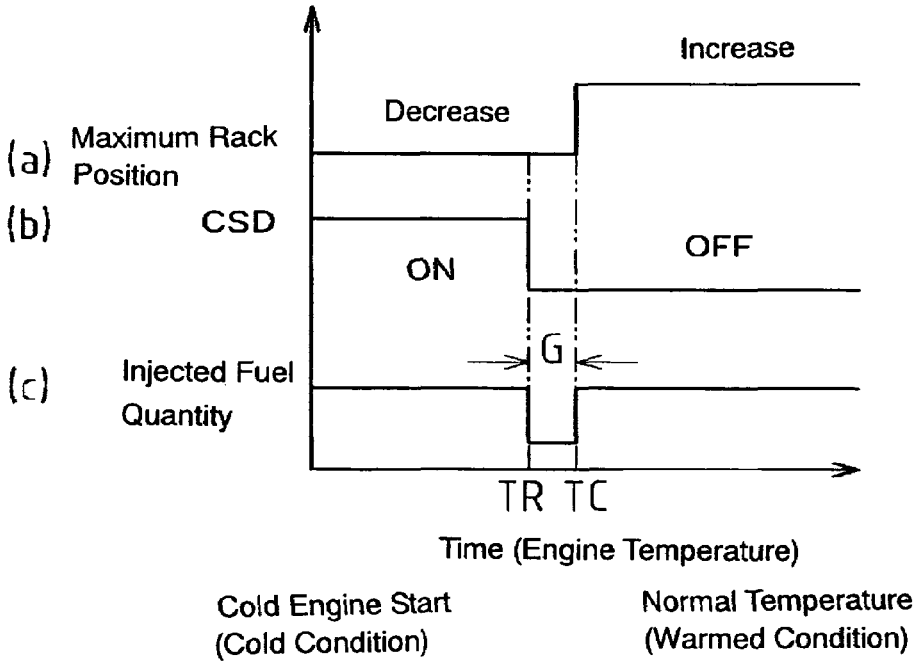
FIG. 8 corresponds to FIG. 5 showing a problem caused when the timing of change of maximum rack position and the timing of change of the CSD are reversed.

Referring to FIG. 8, if the shift of the CSD and the starting of the cold governing for decreasing injected fuel are performed at respective timings TR and TC whose order shown in FIG. 5 is reversed, the injected fuel is temporarily decreased for only a time lag G between timings TR and TC.

In this case, the injected fuel quantity required for normally driving an engine is not ensured, thereby causing engine trouble.

Referring to FIG. 5, the setting of timing TR to be simultaneous with timing TC for shifting the CSD or earlier than timing TC prevents the temporary decrease of injected fuel as shown in FIG. 8.

In other words, the governor shifts the maximum rack position for increasing injected fuel quantity before the decrease of injected fuel by the switch-off of the CSD, thereby preventing the temporary decrease of injected fuel and preventing engine trouble.

The CSD to be shifted in the above way may be electronic CSD 9 replacing thermoelement CSD 47. Mechanical governor 17 may be provided with the mechanism for shifting the fulcrum of the governor lever, which serves as the mechanism for executing the cold governing for decreasing injected fuel, instead of the utilization of the electronic system of electronic governor 2.

A system setting the timings for shifting both the mechanisms in each of fuel injection pump 100 (of the first embodiment) and fuel injection pump 200 (of the second embodiment) will be detailed.

Firstly, the system setting the timings for shifting both the mechanisms in fuel injection pump 100 of first embodiment will be described. Fuel injection pump 100 includes thermoelement CSD 47 and electronic governor 2.

Detection of engine cooling water temperature replaces the detection of engine temperature for thermoelement CSD 47 and electronic governor 2.

As shown in FIG. 4, a cooling water passage 11 passing engine 10 is formed to pass thermoelement CSD 47. The wax serving as the thermoelement of thermoelement CSD 47 is contracted or expanded depending upon heat from engine cooling water, so as to drive piston 46, thereby switching on and off thermoelement CSD 47.

On the way of cooling water passage 11 is disposed a cooling water sensor 12 for detecting the cooling water temperature to be used for governing of electronic governor 2. Cooling water sensor 12 is connected to controller 5 so as to serve as means for detecting the cooling water temperature to be used for judging whether the condition is suitable for setting the timing of execution-to-cancel shift of the cold governing for decreasing injected fuel. Controller 5 drives actuator 3 for shifting the rack position so as to increase and decrease the injected fuel quantity in correspondence to the cooling water temperature detected by cooling water sensor 12.

With respect to the cooling water flow direction in cooling water passage 11, cooling water sensor 12 for judging execution or cancel of the cold governing for decreasing injected fuel is disposed on the upstream side of thermoelement CSD 47.

Therefore, the cooling water temperature necessarily rises in the thermoelement (wax) portion of thermoelement CSD 47 earlier than that in the detection portion of cooling water sensor 12. Consequently, even if the temperature for shifting thermoelement CSD 47 is set equal to the temperature for shifting the governing of electronic governor 2, electronic governor 2 necessarily shifts the maximum rack position in the fuel decreasing direction before the switch-off of thermoelement CSD 47.

As shown in FIG. 5, as the cooling water temperature increases, electronic governor 2 shifts the maximum rack position set in the fuel decreasing direction into the fuel increasing direction, and then, switched-on thermoelement CSD 47 is switched off.

Accordingly, the above-mentioned temporary decrease of injected fuel quantity is surely prevented.

Next, the system setting the timings for shifting both the mechanisms in will be described.

Figure 9:
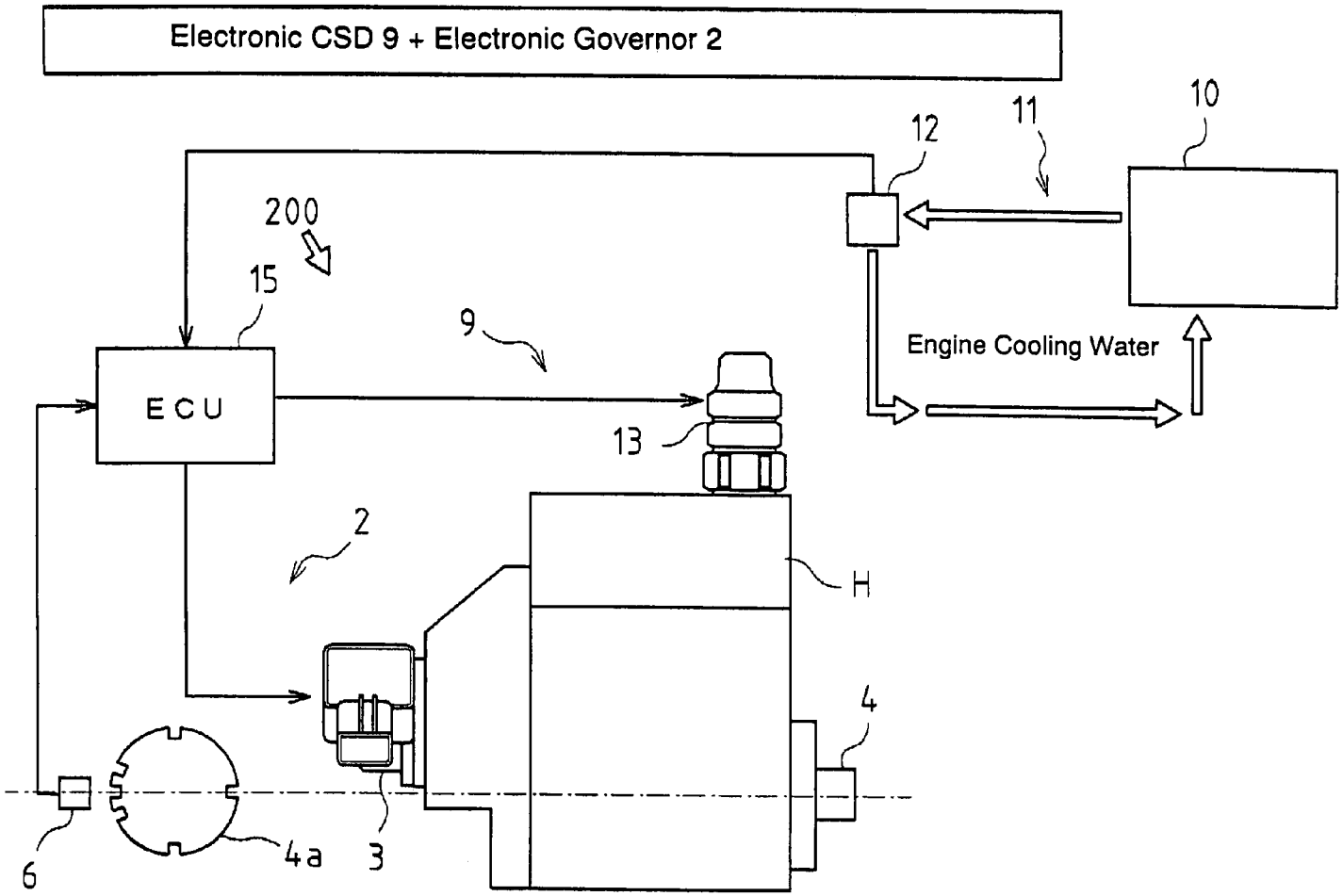
FIG. 9 is a systematic diagram of a fuel injection pump 200 including an electronic CSD 47 and electronic governor 2.

Configuration of fuel injection pump 200 will now be described. As shown in FIG. 9, fuel injection pump 200 includes electronic CSD 9 and electronic governor 2. Electronic CSD 9 includes a solenoid type actuator 13 serving as means for driving piston 46, and a controller 15 for driving actuator 13. The configuration of electronic governor 2 of fuel injection pump 200 is the same as that of fuel injection pump 100, thereby being designated by the same reference numeral. Controller 15 replacing controller 5 is used as means for controlling both electronic CSD 9 and electronic governor 2.

As shown in FIG. 9, electronic governor 2 provided with electronic CSD 9 can execute the cold governing for decreasing injected fuel, and uses cooling water sensor 12 serving as means detecting engine temperature for controlling electronic CSD 9 and for the cold governing for decreasing injected fuel.

Depending upon the detection by the only single cooling water sensor 12, both the control of electronic CSD 9 and the cold governing for decreasing injected fuel are performed.

Figure 10:
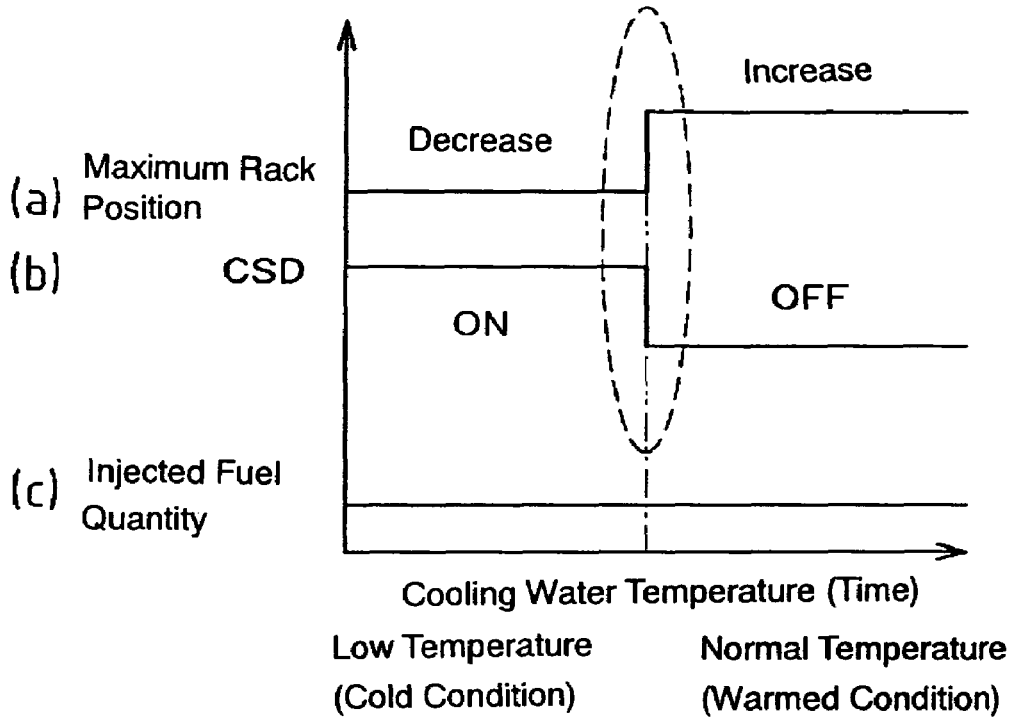
FIG. 10 illustrate a graph (a) of change of maximum rack position, a graph (b) of change of on/off condition of CSD, and a graph (c) of change of governor control condition, when a common cooling water sensor 12 is provided for the CSD and the governor.

Therefore, as shown in FIG. 10, the timing for switch on-to-off shift of electronic CSD 9 can be substantially simultaneous to the timing for the fuel decrease-to-increase shift of electronic governor 2.

With respect to mechanical governor 17 of fuel injection pump 300 (of the third embodiment), the control of electronic CSD 9 and the cold governing for decreasing injected fuel also depend on only single cooling water sensor 12 for detection of water temperature.

In this regard, electronic CSD 9 and mechanical governor 17 are provided with the mechanism for shifting the fulcrum of the governor lever, and the mechanism is controlled based on the cooling water temperature detection by only single cooling water sensor 12, thereby enabling substantially synchronization of the timing for the switch on-to-off shift of electronic CSD 9 with the timing for the fuel decrease-to-increase shift of mechanical governor 17.

Description will be given of engine rotary speed control for a fuel injection pump including electronic governor 2.

Each of fuel injection pumps 100 and 200 has electronic governor 2. However, only fuel injection pump 100 is referred to for this description because the CSD may be any type regardless of the rotary speed control. It should be noticed that the timing setting of pump 100 for the rotary speed control becomes different from the timing setting of pump 200 for the rotary speed control because the timing for shifting the rack position of pump 100 is different from the timing for shifting the rack position of pump 200.

Immediately after the switch-off of the CSD, the injected fuel quantity every rack position is decreased, thereby decreasing the engine rotary speed.

Figure 11:
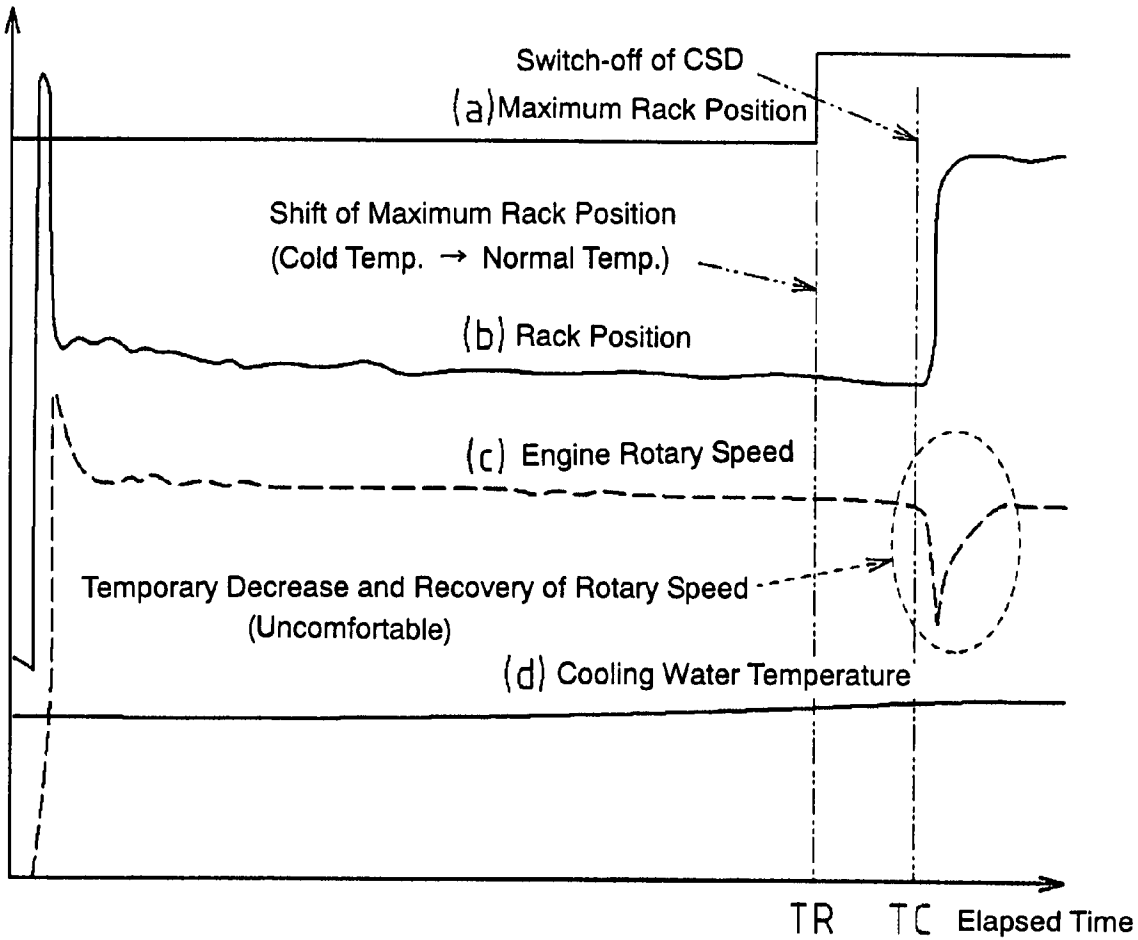
FIG. 11 illustrate a graph (a) of change of maximum rack position, a graph (b) of change of rack position, a graph (c) of change of engine rotary speed, and a graph (d) of change of cooling water temperature, when the governor performs isochronus governing.

Referring to FIG. 11, the rotary speed change constantly depends on the isochronus governing. Electronic governor 2 shifts the maximum rack position at timing TR, and thermoelement CSD 47 is shifted into the switch off condition at timing TC.

Due to the shift of the maximum rack position, the allowed variation range of the rack position is changed, thereby enabling the rack position to be shifted into the fuel increasing direction so as to compensate for the decrease of injected fuel quantity caused by the switch-off of the thermoelement CSD 47.

With respect to the isochronus governing, the engine rotary speed is temporarily decreased at the time of the shift of thermoelement CSD 47 into the switch-off condition. However, the rack position is shifted for increasing the injected fuel quantity so as to compensate for the decrease of injected fuel quantity caused by the switch-off the thermoelement CSD 47, thereby recovering the engine rotary speed.

In this way, the rotary speed is decreased, and then increased to the original speed. Therefore, an operator operating a machine with engine 10 serving as a power source feels discomfort, in comparison with the case of normal idle-up governing.

Figure 12:
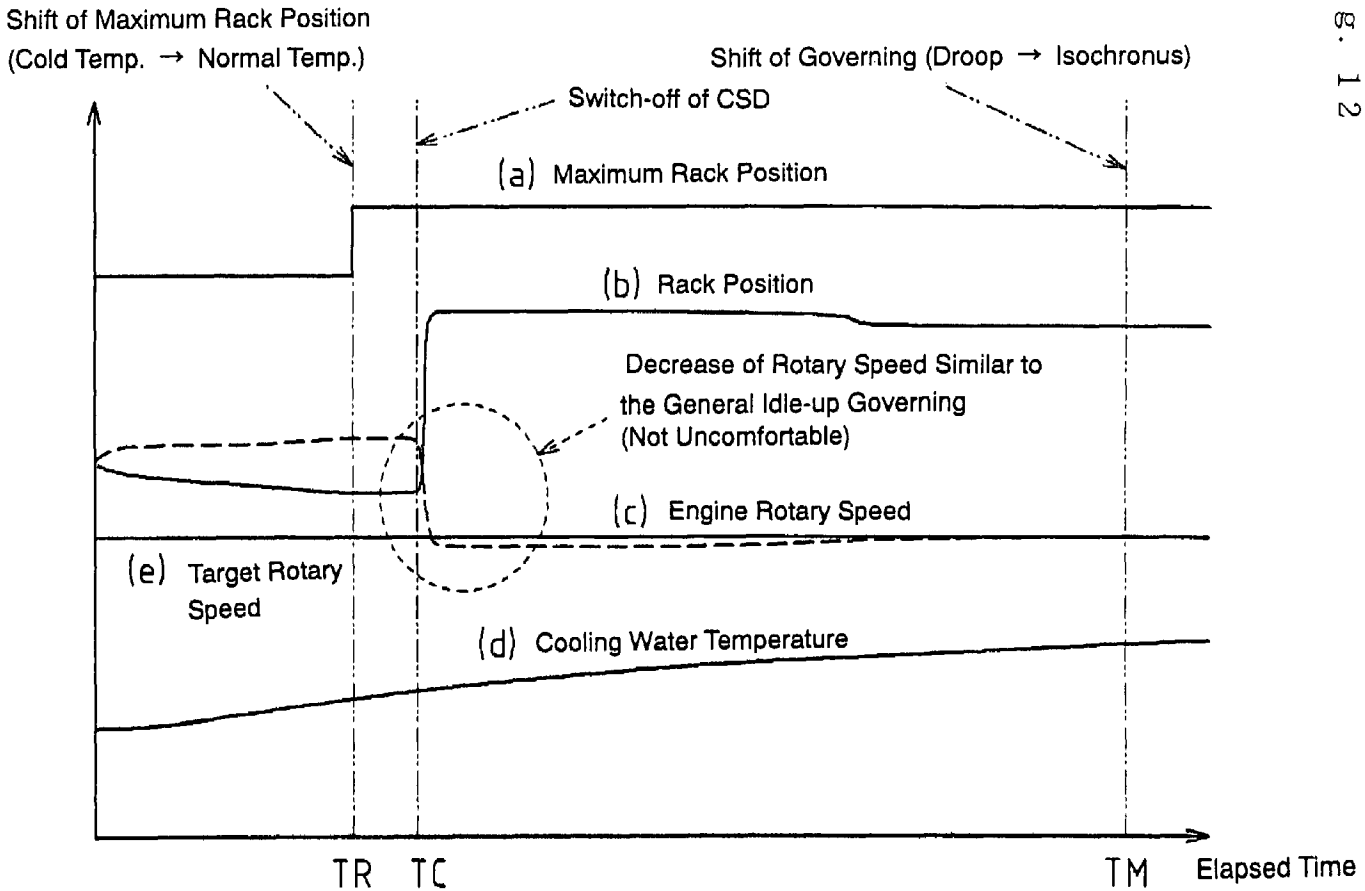
FIG. 12 illustrate a graph (a) of change of maximum rack position, a graph (b) of change of rack position, a graph (c) of change of engine rotary speed, a graph (d) of change of cooling water temperature, a graph (d) of change of target rotary speed, when the governor performs isochronus governing.

Referring to FIG. 12, the rotary speed change during warming-up of the engine depends the droop governing. Electronic governor 2 shifts the maximum rack position at timing TR, and thermoelement CSD 47 is shifted into the switch off condition at timing TC.

Due to the shift of the maximum rack position, the allowed variation range of the rack position is changed, thereby enabling the rack position to be shifted into the fuel increasing direction so as to compensate for the decrease of injected fuel quantity caused by the switch-off of the thermoelement CSD 47.

With respect to the droop governing, the engine rotary speed is decreased at the time of the shift of thermoelement CSD 47 into the switch-off condition. Afterward, the rack position is shifted to compensate for the decrease of injected fuel quantity, the decrease of the engine rotary speed stops, and then the decreased rotary speed is kept constant.

In anticipation of the decrease of engine rotary speed after the switch-off shift of the CSD, engine 10 is driven at a higher rotary speed than a target speed before the thermoelement CSD 47 is shifted into the switch-off condition.

After the decrease of rotary speed, the decreased rotary speed is kept constant. This rotary speed change, which is similar to that according to the idle-up governing, is not uncomfortable for the operator operating a machine with engine 10 serving as the power source.

Controller 5 programs to turn the droop governing into the isochronus governing after the end of the switch-off shift of thermoelement CSD 47.

The droop governing is performed during warming-up of the engine, and shifted into the isochronus governing after the finish of the warming-up. Therefore, the engine rotary speed can be constant regardless of increase of load, thereby ensuring comfortable work.

Description will be given of a mechanism for shifting the maximum rack position in fuel injection pump 300 of the third embodiment.

Figure 13:
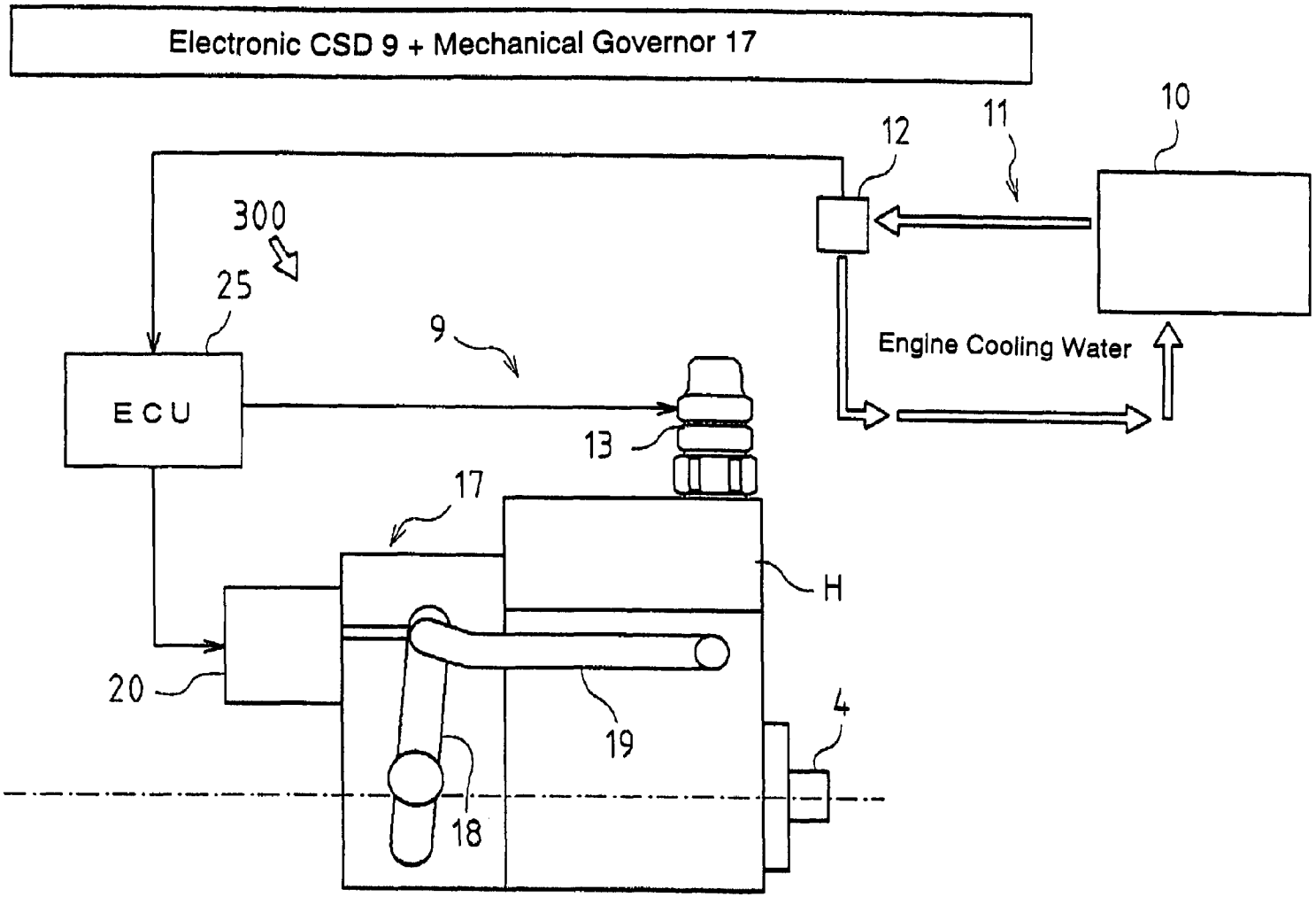
FIG. 13 is a systematic diagram of a fuel injection pump 300 including electronic CSD 9 and a mechanical governor 17.

As shown in FIG. 13, fuel injection pump 300 includes electronic CSD 9 and mechanical governor 17. The configuration of electronic CSD 9 of fuel injection pump 300 is the same as those of fuel injection pumps 100 and 200, thereby being designated by the same reference numeral. A controller 25, replacing controllers 5 and 15, can also control a later-discussed multi-step solenoid 20.

Mechanical governor 17 includes a governor lever 18 and a control lever 19 so as to constitute a mechanical system for automatically adjusting the injected fuel quantity in correspondence to the engine rotary speed. Governor lever 18 rotates according to acceleration and deceleration of camshaft 4. Control lever 19 rotated according to the opening degree of the accelerator throttle. A fulcrum of governor lever 18 is not fixed to a governor casing, and is shifted between a position for fuel-increasing shift of the rack position and a position for fuel-decreasing shift of the rack position according to the rotation of control lever 19. Due to the shift of the fulcrum, the shiftable range of the control rack connected to one end of governor lever 18, i.e., the maximum rack position is changed.

Additionally, mechanical governor 17 is provided with an electronic actuator for rotating the fulcrum of governor lever 18 to the position for fuel-decreasing shift of the rack position, so as to serve as the mechanism for executing the cold governing for decreasing injected fuel. The actuator comprises multi-step solenoid 20, provided with a normal position, a fuel-decreasing position, and an engine stop position.

Controller 25 of electronic CSD 9 controls multi-step solenoid 20, and actuator 13 of electronic CSD 9.

Controller 25 is connected with cooling water sensor 12 for detecting the engine cooling water temperature. Controller 25 simultaneously shifts electronic CSD 9 into the switch-off condition and shifts the maximum rack position for decreasing the injected fuel quantity, based on the detection of the cooling water temperature.

This simultaneous shift timing is set similar to that of fuel injection pump 200 including electronic CSD 9 and electronic governor 2 as shown in FIG. 10.

In this way, in mechanical governor 17, multi-step solenoid 20 serving as the means for shifting the fulcrum of governor lever 18 has first and second effects. The first effect is that, when the injected fuel quantity is increased by the switch-on of the CSD, the fulcrum of governor lever 18 is shifted to the position for shifting the maximum rack position into the fuel-decreasing direction, thereby canceling the increase of injected fuel quantity. The second effect is that the multi-step solenoid can quickly rotate governor lever 18 to a position for stopping the engine.

In other words, multi-step solenoid 20 serving as the means for rotating governor lever 18 can be also used as the means for decreasing the injected fuel quantity, and as the means for preventing the stationary engine from fuel injection, thereby saving a space for the governor.

Description will be given of fuel injection pumps 400 and 500, each of which switches off the CSD in a certain condition.

Each of fuel injection pump 400 according to the fourth embodiment and fuel injection pump 500 according to the fifth embodiment includes electronic CSD 9, and is additionally provided with the mechanism for the switch-off shift of the CSD in the certain condition.

Each of fuel injection pumps 200 and 300 has electronic CSD 9. However, only fuel injection pump 200 is referred to for this description because the governor may be any type.

Figure 14:
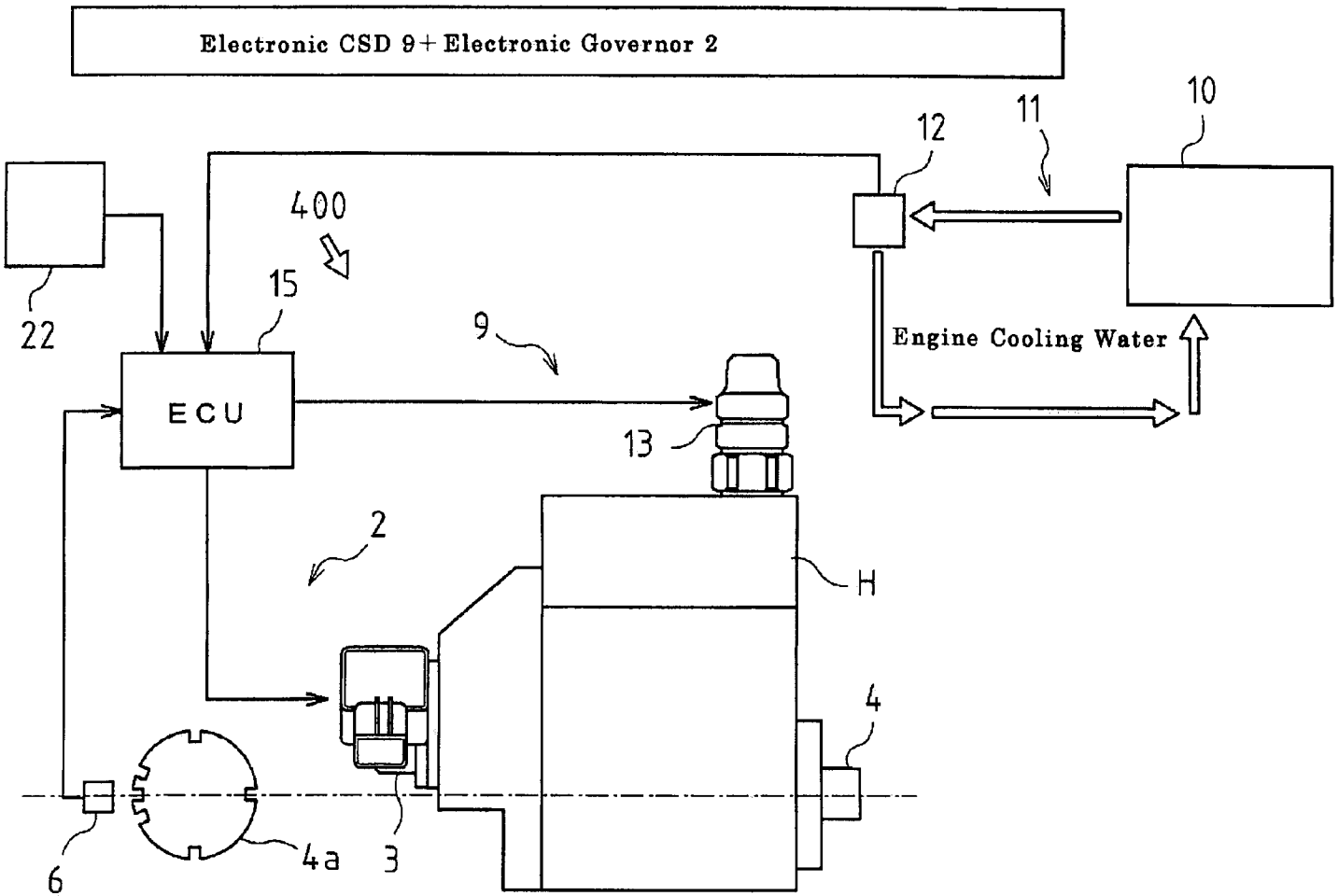
FIG. 14 is a systematic diagram of a fuel injection pump 400 including a mechanism for switch-off the CSD after a certain time passage.

Referring to FIG. 14, configuration of fuel injection pump 400 of the fourth embodiment will be described.

As shown in FIG. 14, fuel injection pump 400 includes a timer 22 added to the same configuration of fuel injection pump 200. Timer 22 is connected to controller 15.

Timer 22 starts counting simultaneously to the cold engine start. When a certain time has passed, timer 22 sends a CSD switch-off signal to controller 15. Controller 15 receives the CSD switch-off signal and moves actuator 13 to a CSD switch-off position.

Figure 15:
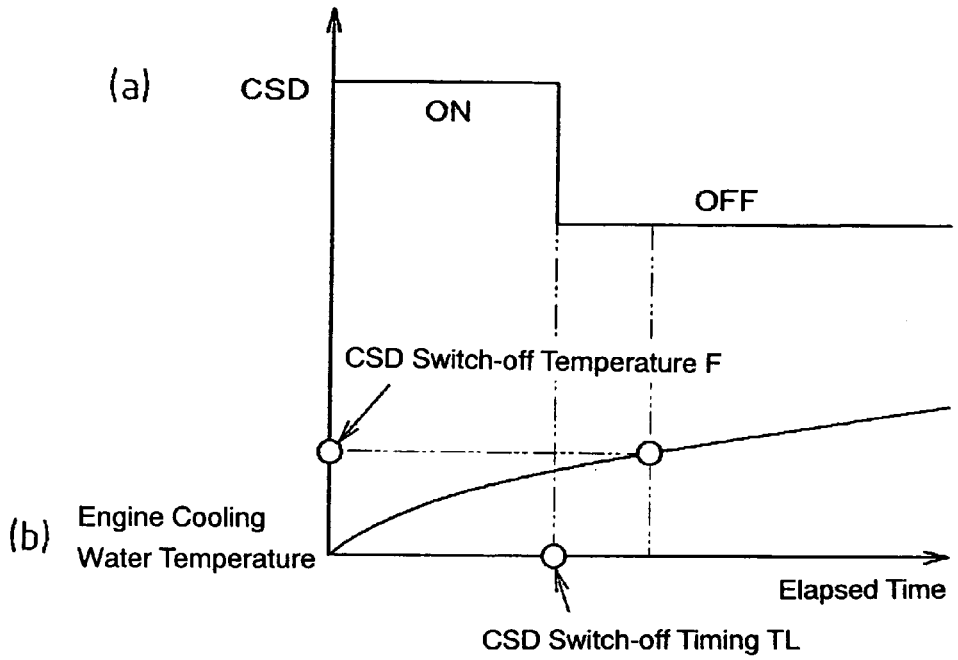
FIG. 15 illustrates a graph (a) of change of CSD condition, and a graph (b) of change of cooling water temperature, in a case that the CSD is switched off by a certain time passage.

As shown in FIG. 15, the CSD is shifted into the switch-off condition if the certain time passage is counted (a time counted since the cold engine start reaches a CSD switch-off timing TL) before the cooling water temperature reaches a CSD switch-off temperature F.

Figure 16:
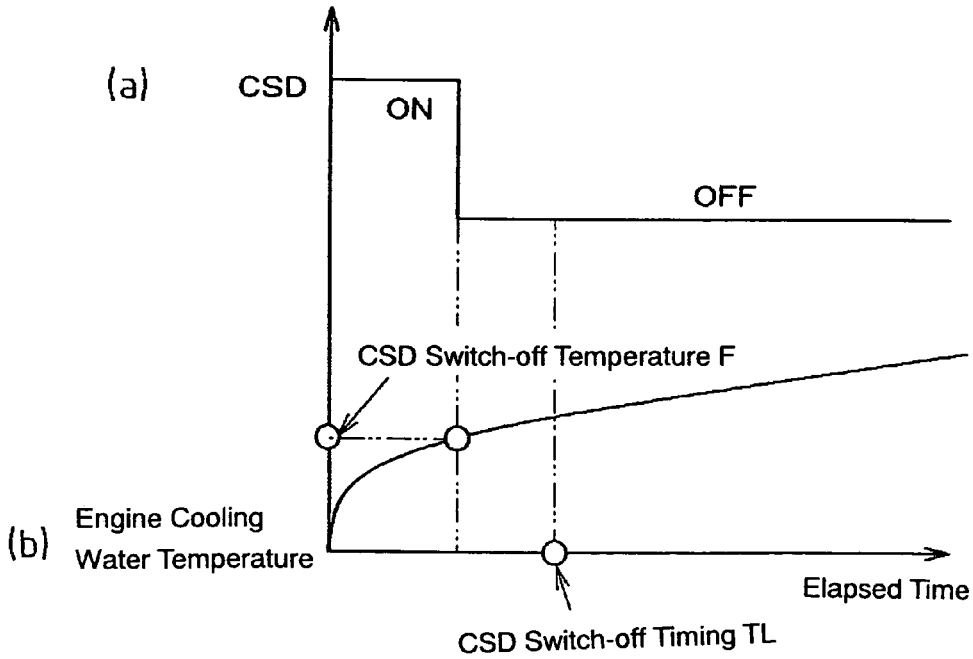
FIG. 16 illustrates a graph (a) of change of CSD condition, and a graph (b) of change of cooling water temperature, in a case that the CSD is switched off by rise of cooling water temperature.

On the other hand, as shown in FIG. 16, the CSD is shifted into the switch-off condition regardless of the counting of timer 22, similar to that of fuel injection pump 200, if the cooling water temperature reaches CSD switch-off temperature F before the certain time passage is counted.

Consequently, in fuel injection pump 400 including electronic CSD 9 sensing the cooling water temperature, the CSD, switched on when the cold engine starts, is shifted into the switch-off condition by passage of the certain time (when CSD switch-off timing TL is counted from the cold engine start) even if the cooling water temperature does not reach the certain temperature (the CSD switch-off temperature).

Therefore, the CSD can be surely switched off even if controller 5 cannot detect the cooling water temperature because cooling water sensor 12, a harness or the like has a problem, or even if an abnormally long time is required for increasing the cooling water temperature because a cooling water pump or the like has a problem. Namely, the CSD can be provided with a fail-safe function.

Figure 17:
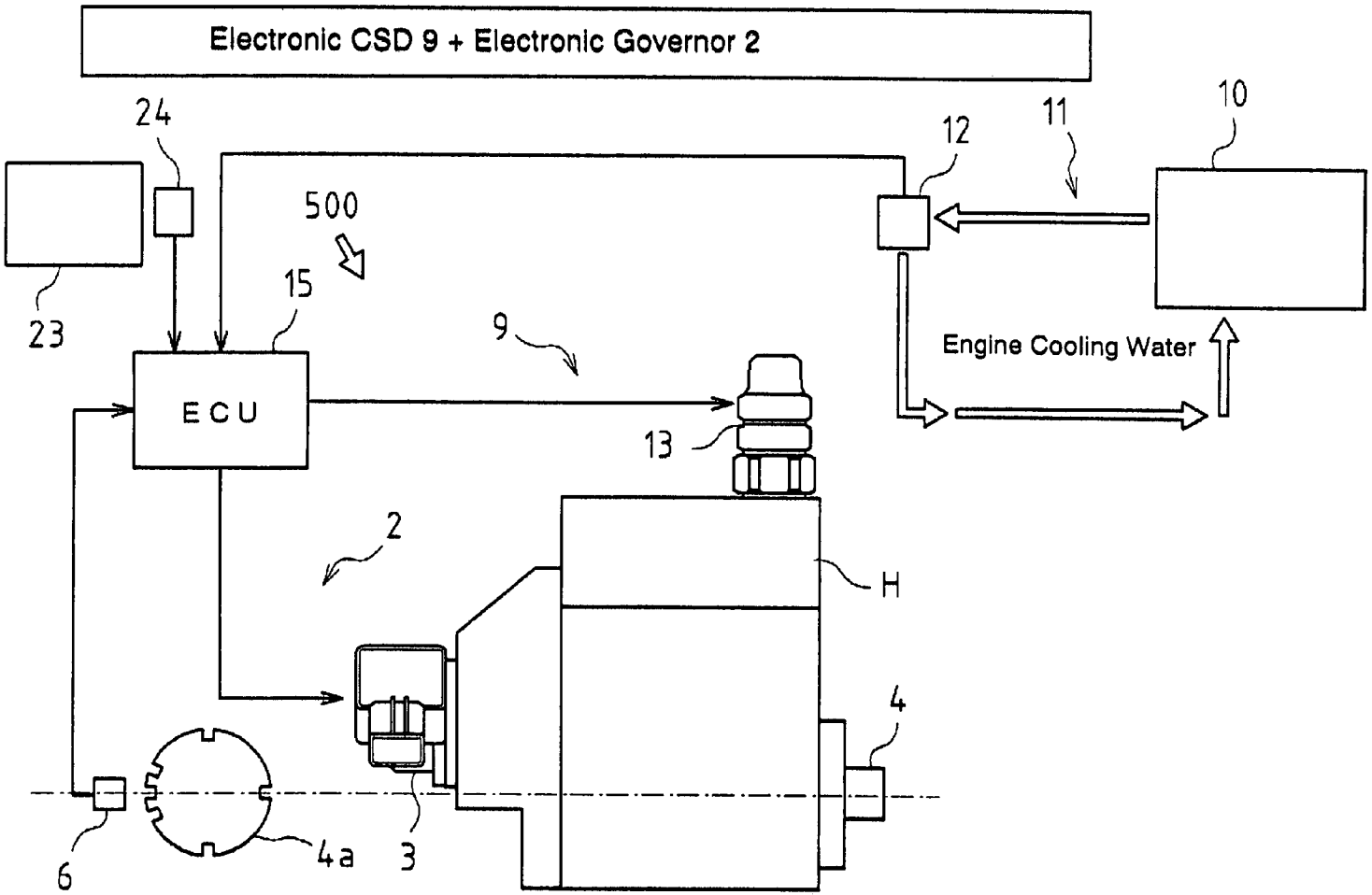
FIG. 17 is a systematic diagram of a fuel injection pump 500 including a mechanism for switch-off the CSD based on a clutch signal.

Referring to FIG. 17, configuration of fuel injection pump 500 of the fifth embodiment will be described.

As shown in FIG. 17, fuel injection pump 500 includes a clutch condition sensor 24 for detecting whether a clutch 23 is engaged or disengaged, in addition to the configuration of fuel injection pump 200. Clutch condition sensor 24 is connected to controller 15. Clutch 23 is provided on a power transmission way to a working machine (not shown) driven by engine 10.

Clutch condition sensor 24 detects whether clutch 23 is engaged or not, and sends a clutch signal concerning to detection of the condition of clutch 23. Controller 15 receives a clutch signal indicating the clutch-on condition, and moves actuator 13 to a CSD switch-off position.

Figure 18:
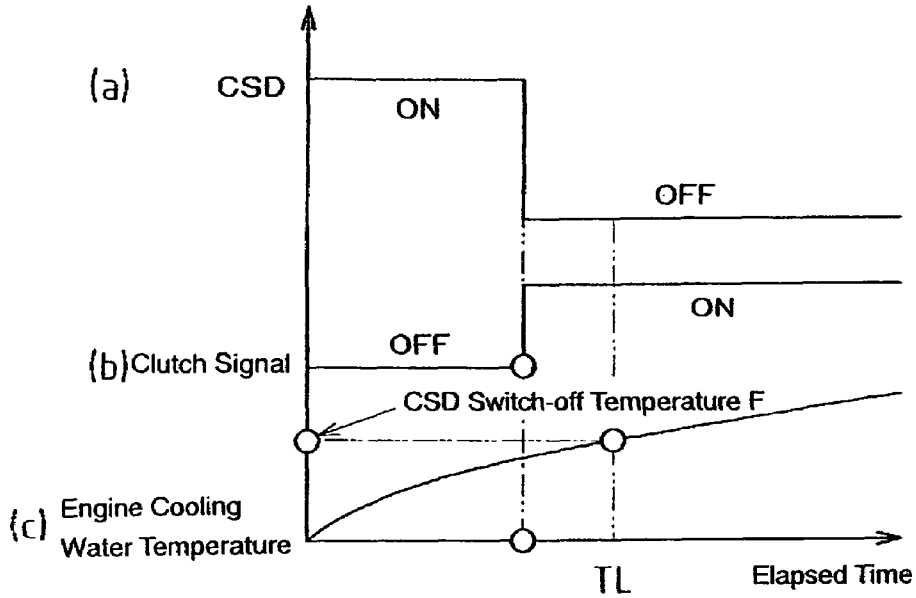
FIG. 18 illustrates a graph (a) of change of CSD condition, a graph (b) of change of clutch signal, and a graph (c) of change of cooling water temperature, in a case that the CSD is switched off by detection of a clutch-on condition.

As shown in FIG. 18, controller 15 shifts the CSD into the switch-off condition if controller 15 receives the clutch signal indicating the clutch-on condition before the cooling water temperature reaches a CSD switch-off temperature F.

Figure 19:
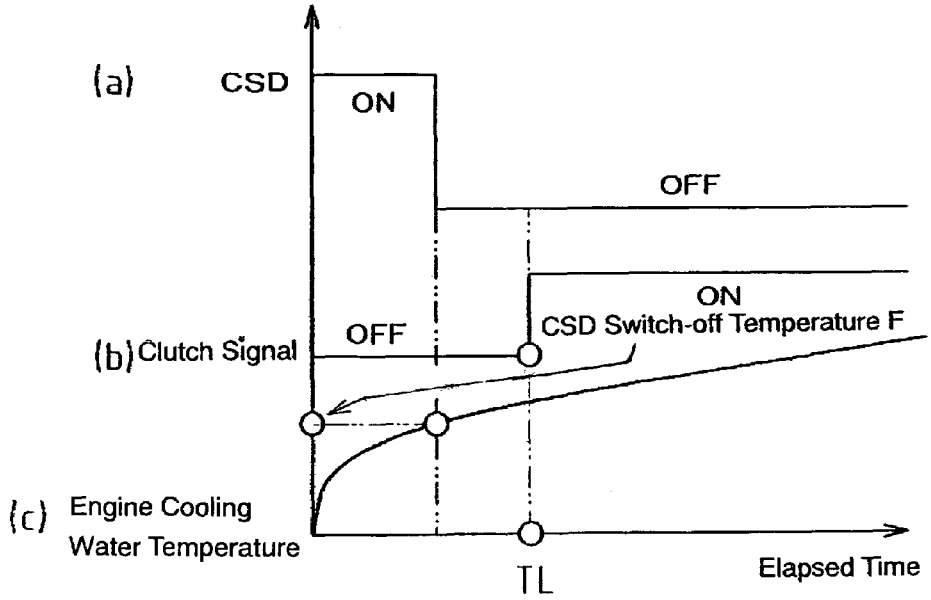
FIG. 19 illustrates a graph (a) of change of CSD condition, a graph (b) of change of clutch signal, and a graph (c) of change of cooling water temperature, in a case that the CSD is switched off by rise of cooling water temperature.
Figure 20:
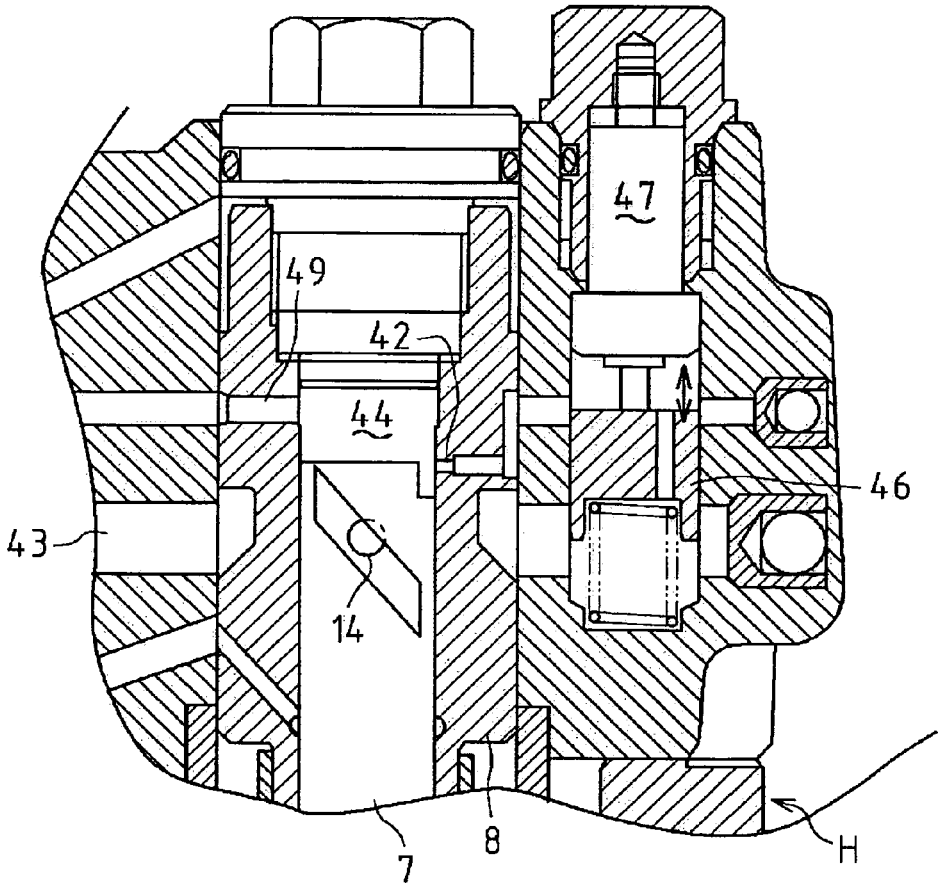
FIG. 20 is a view of a structure for controlling injection timing disclosed in Japanese Laid Open No. 2000-234576.
Figure 21:
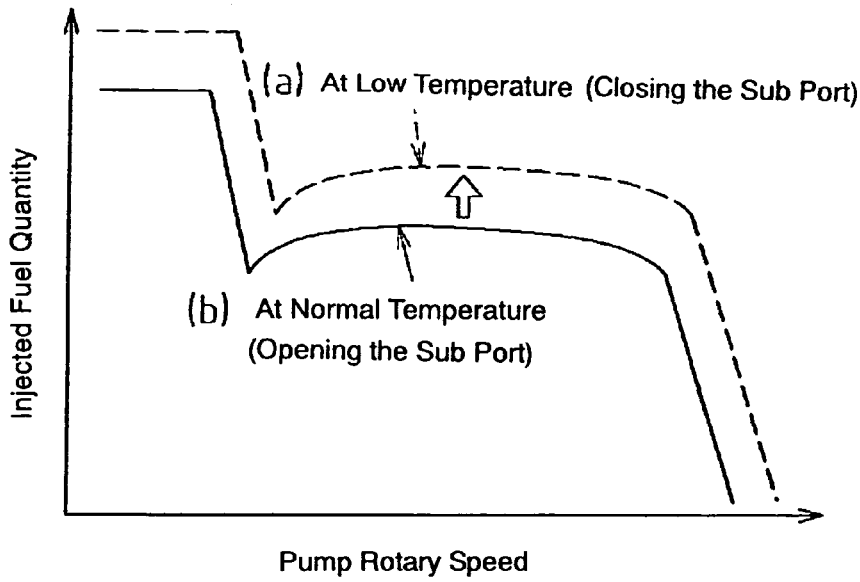
FIG. 21 illustrates graphs of injected fuel quantity relative to pump rotary speed.
Figure 22:
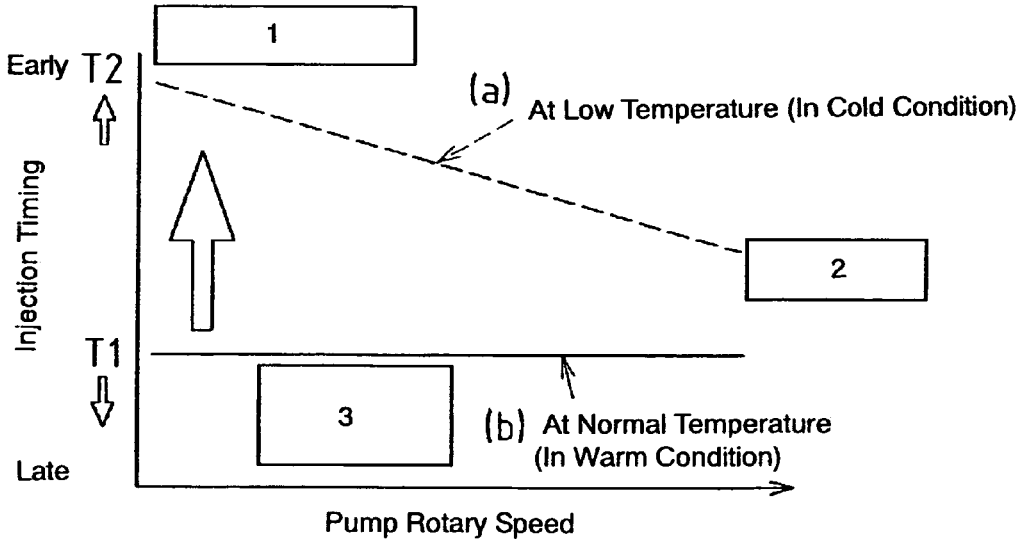
FIG. 22 illustrates graphs of injection timing relative to pump rotary speed.

On the other hand, as shown in FIG. 19, the CSD is shifted into the switch-off condition regardless of the clutch signal, similar to that of fuel injection pump 200, if the cooling water temperature reaches CSD switch-off temperature F before controller 15 receives the clutch signal indicating the clutch-on condition.

Consequently, in fuel injection pump 500 including electronic CSD 9 sensing the cooling water temperature, the CSD, switched on when the cold engine starts, is shifted into the switch-off condition by detecting the clutch-on condition of the working machine even if the cooling water temperature does not reach the certain temperature (the CSD switch-off temperature).

Therefore, in anticipation that engine 10 is loaded by driving the working machine, the CSD, which is another source of load, can be shifted into the switch-off condition so as to prevent engine 10 from being overloaded.

INDUSTRIAL APPLICABILITY

The present fuel injection pump is a suitable fuel injection pump for diesel engines.

What is claimed is:

1. A fuel injection pump comprising:

a plunger barrel;

a sub port for overflow of fuel formed in the plunger barrel;

a cold start device for advancing injection timing in a cold temperature condition, the cold start device using a piston for opening and closing the sub port; and a governor, wherein the governor performs cold governing for decreasing injected fuel so as to decrease an injected fuel quantity at a time of engine start in a cold temperature condition.

2. The fuel injection pump according to claim 1, wherein a timing for turning the decreased fuel injection for the engine starting in the cold temperature into normal fuel injection for the engine in a normal temperature condition is set before or simultaneous to a timing for switching-off the switched-on cold start device.

3. The fuel injection pump according to claim 1, the governor including an electronic actuator for the cold governing for decreasing injected fuel, wherein a temperature of engine-cooling water is detected for switch-on/off of the cold start device and for execution/cancel of the cold governing for decreasing injected fuel with the governor.

4. The fuel injection pump according to claim 3, the cold start device being a thermoelement cold start device sensing the temperature of the engine-cooling water, wherein the governor has a sensor for detecting the temperature of the engine-cooling water disposed on the upstream side of a thermoelement portion of the cold start device in flow of the engine-cooling water.

5. The fuel injection pump according to claim 3, the cold start device being an electronic cold start device, wherein the temperature of the engine-cooling water is detected by a single sensor for switch-on/off of the electronic cold start device and for execution/cancel of the cold governing for decreasing injected fuel with the governor.

6. The fuel injection pump according to claim 1, the governor being an electronic governor, wherein the governor performs droop governing during the switch-on condition of the cold start device and for a certain period after the shift of the switched-on cold start device into the switch-off condition, and wherein the governor performs isochronus governing for the rest period while the cold start device is switched off.

7. The fuel injection pump according to claim 1, the governor being an electronic governor, wherein the governor is provided with two map data for controlling a maximum rack position of the governor, wherein one of the map data is selected when the cold start device is switched on, and the other map data is selected when the cold start device is switched off.

8. The fuel injection pump according to claim 1, the governor being a mechanical governor, wherein a multi-step actuating solenoid is provided for moving a fulcrum of a governor lever of the mechanical governor in a fuel decreasing direction and in a fuel increasing direction.

9. The fuel injection pump according to claim 2, the governor including an electronic actuator for the cold governing for decreasing injected fuel, wherein a temperature of engine-cooling water is detected for switch-on/off of the cold start device and for execution/cancel of the cold governing for decreasing injected fuel with the governor.

10. The fuel injection pump according to claim 9, the cold start device being a thermoelement cold start device sensing the temperature of the engine-cooling water, wherein the governor has a sensor for detecting the temperature of the engine-cooling water disposed on the upstream side of a thermoelement portion of the cold start device in flow of the engine-cooling water.

11. The fuel injection pump according to claim 9, the cold start device being an electronic cold start device, wherein the temperature of the engine-cooling water is detected by a single sensor for switch-on/off of the electronic cold start device and for execution/cancel of the cold governing for decreasing injected fuel with the governor.

* * * * *